US007286776B2

(12) United States Patent
Morita et al.

(10) Patent No.: US 7,286,776 B2
(45) Date of Patent: Oct. 23, 2007

(54) COLOR IMAGE FORMING APPARATUS WITH VIBRATION CONTROL METHOD FOR CONTROLLING THE SAME AND CONTROL PROGRAM FOR IMPLEMENTING THE METHOD

(75) Inventors: Kenji Morita, Toride (JP); Hidehiko Kinoshita, Kashiwa (JP); Hitoshi Kato, Toride (JP); Masahiro Serizawa, Toride (JP); Katsuyuki Yamazaki, Toride (JP); Yuichi Yamamoto, Abiko (JP)

(73) Assignee: Canon Kabushiki Kaisha (JP)

( * ) Notice: Subject to any disclaimer, the term of this patent is extended or adjusted under 35 U.S.C. 154(b) by 253 days.

(21) Appl. No.: 11/240,052

(22) Filed: Sep. 30, 2005

(65) Prior Publication Data

US 2006/0072940 A1 Apr. 6, 2006

(30) Foreign Application Priority Data

Oct. 1, 2004 (JP) ..... 2004-290564

(51) Int. Cl.
*G03G 15/00* (2006.01)

(52) U.S. Cl. ..... 399/36; 399/227

(58) Field of Classification Search ..... 399/31, 399/36, 54, 223, 226, 227, 228, 229, 230
See application file for complete search history.

(56) References Cited

U.S. PATENT DOCUMENTS 5,585,598 A * 12/1996 Kasahara et al. ..... 399/227
6,060,813 A 5/2000 Nowak
6,748,188 B2 * 6/2004 Kishigami et al. ..... 399/227
6,813,459 B2 * 11/2004 Kishigami ..... 399/227
6,831,665 B2 * 12/2004 Tsuda et al. ..... 715/740
6,985,684 B2 * 1/2006 Matsuo et al. ..... 399/227
2005/0281568 A1 * 12/2005 Hashizume ..... 399/27
2006/0072948 A1 * 4/2006 Miyake et al. ..... 399/361
2006/0153588 A1 * 7/2006 Sakai et al. ..... 399/110

FOREIGN PATENT DOCUMENTS

JP 61107361 A * 5/1986
JP 5-19558 A 1/1993
JP 8-146843 A 6/1996
JP 11-194608 A 7/1999
JP 2001134044 A * 5/2001
JP 2003235296 A * 8/2003
JP 2003312049 A * 11/2003

* cited by examiner

*Primary Examiner*—Robert Beatty
(74) *Attorney, Agent, or Firm*—Rossi, Kimms & McDowell, LLP

(57) ABSTRACT

A color image forming apparatus which is capable of preventing deterioration in image formation quality caused by vibrations of a developing unit without halting an image forming operation and using a simple construction. A developing rotary unit incorporates developing devices corresponding to respective ones of a plurality of image formation colors. In forming an image, the developing rotary unit is moved to location for development of an image of each of the plurality of image formation colors. The level of vibrations applied to the developing rotary unit is detected, and the drive control pattern for the developing rotary unit is determined depending on the detected level of vibrations.

8 Claims, 11 Drawing Sheets

FIG. 7

| | VIBRATION LEVEL DURING ACCELERATION | | VIBRATION LEVEL DURING DECELERATION | |
|---|---|---|---|---|
| VIBRATION LEVEL DURING CONSTANT-SPEED ROTATION | LESS THAN TH1 | NOT LESS THAN TH1 | LESS THAN TH1 | NOT LESS THAN TH1 |
| LESS THAN TH2 | T1 = T1r<br>V1 = V1r | T1 > T1r<br>V1 > V1r | T2 = T2r<br>V1 = V1r | T2 > T2r<br>V1 > V1r |
| NOT LESS THAN TH2 | T1 = T1r<br>V1 = V1r | T1 > T1r<br>V1 = V1r | T2 = T2r<br>V1 = V1r | T2 > T2r<br>V1 > V1r |

COLOR IMAGE FORMING APPARATUS WITH VIBRATION CONTROL METHOD FOR CONTROLLING THE SAME AND CONTROL PROGRAM FOR IMPLEMENTING THE METHOD

BACKGROUND OF THE INVENTION

1. Field of the Invention

The present invention relates to a color image forming apparatus and a method of controlling the same that carry out a developing process by moving a developing unit in which developing devices corresponding to a plurality of image formation colors are incorporated, as well as a control program for implementing the method.

2. Description of the Related Art

Conventionally, there has been known a rotary developing type full-color image forming apparatus that carries out a developing process by rotating a developing rotary unit in which a plurality of developing units corresponding to respective image formation colors are incorporated.

FIG. 9 is a diagram schematically showing the construction of a conventional rotary developing type full-color image forming apparatus of this type.

The full-color image forming apparatus in FIG. 9 is comprised of a color reader section 400 that scans the entire surface of an original to read an image thereon in full color, and a color printer section 500 that prints out color image data read by the color reader section 400.

The color printer section 500 is comprised of a developing rotary 503 in which developing devices 503Y, 503M, 503C, and 503K corresponding to respective four colors (yellow, magenta, cyan, and black) are incorporated. A laser scanner 501, which is installed in the color printer section 500, scans a laser beam corresponding to image data generated by the color reader section 400 and irradiates the laser beam onto a photosensitive drum 502. As a result, an electrostatic latent image is formed on the photosensitive drum 502.

When the electrostatic latent image on the photosensitive drum 502 reaches the position of a sleeve of a predetermined color among sleeves 53Y, 53M, 53C, and 53K corresponding to the respective image formation colors in the developing rotary unit 503, a toner of the predetermined color is jetted from the concerned developing device to the surface of the photosensitive drum 502, so that the electrostatic latent image on the surface of the photosensitive drum 502 is developed. Then, the toner image formed on the photosensitive drum 502 is transferred onto an intermediate transfer member 505. In the case where the read image is a full color image, the sleeves of the respective colors are sequentially positioned at a predetermined location that is to face the electrostatic latent image on the photosensitive drum 502 by rotating the developing rotary unit 503, to develop/transfer electrostatic latent images corresponding to the respective colors on the photosensitive drum 502.

On the other hand, a recording sheet picked up from a cassette 508 is conveyed to a nip between the intermediate transfer member 505 and a transfer roller 506 in timing with the completion of the transfer to the intermediate transfer member 505. Then, the recording sheet is conveyed toward a fixing device 510 and attached under pressure to the intermediate transfer member 505 at the same time, and as a result, the toner image on the intermediate transfer member 505 is transferred onto the recording sheet. The toner image transferred onto the recording sheet is fixed onto the recording sheet by heating and pressurizing by fixing rollers of the fixing device 510 and pressurizing rollers 507.

As stated above, in the rotary developing system of the conventional full-color image forming apparatus, the sleeves of the respective colors are sequentially positioned at the predetermined location by rotating the developing rotary unit 503 such that the respective sleeves sequentially face the electrostatic latent image on the photosensitive drum 502, and then the developing process is carried out. In forming an image, the developing rotary unit 503 is rotated using a stepping motor so as to change image formation colors (yellow, magenta, cyan, and black).

However, there occur variations in the amounts of color toners consumed depending on secular changes of the image forming apparatus and distribution of colors in images formed, and this leads to increased vibrations created by the developing rotary unit 503 when it starts or stops rotating. As a result, the vibrations created by the developing rotary unit 503 are transmitted to the laser scanner 501, the photosensitive drum 502, the intermediate transfer member 505, and so forth to shift the laser irradiation position and cause splash of toners. This adversely affects the quality of images formed.

To cope with deterioration in image quality caused by such vibrations during image formation, there have been proposed a method in which an image forming operation is inhibited or temporarily halted depending on the level of vibrations during image formation (see Japanese Laid-Open Patent Publication (Kokai) Nos. H05-019558 and H08-146843), and a method in which vibrations that have occurred are canceled out by creating vibrations in opposite phase to the vibrations that have occurred (see Japanese Laid-Open Patent Publication (Kokai) No. H11-194608 and U.S. Pat. No. 6,060,813).

However, where the full-color image forming apparatus is connected to a network and remotely used as a printer, it is desirable to reduce the frequency with which the image forming apparatus is stopped to the minimum possible level while it is in use. In this example, adopting the above method in which an image forming operation is inhibited or temporarily halted so as to cope with deterioration in image quality caused by vibrations created during image formation interferes with smooth usage of the image forming apparatus.

Also, in the above method in which vibrations in opposite phase to vibrations that have occurred are created, a sensor with high responsiveness and accuracy and a device for creating vibrations are required, and hence the image forming apparatus is complicated in construction and expensive, and in addition, excess electric power is needed to create vibrations.

In view of the foregoing, a full-color image forming apparatus that is capable of continuing to carry out an image forming operation even when vibrations occur, and is inexpensive and simple in construction is desired.

SUMMARY OF THE INVENTION

It is an object of the present invention to provide a color image forming apparatus and a method of controlling the same, which are capable of preventing deterioration in image formation quality caused by vibrations of a developing unit without halting an image forming operation and using a simple construction, as well as a control program for implementing the method.

To attain the above object, in a first aspect of the present invention, there is provided a color image forming apparatus comprising a developing unit that incorporates developing devices corresponding to respective ones of a plurality of image formation colors, a development unit driving device that moves the developing unit to a location for development of an image of each of the plurality of image formation colors when forming an image, a vibration detecting device that detects a level of vibrations applied to the developing unit, and a determining device that is capable of changing a drive control pattern for control driving of the developing unit driving device, and determines the drive control pattern depending on the level of vibrations detected by the vibration detecting device.

With the arrangement of the first aspect of the present invention, the level of vibrations applied to the developing unit is detected, and the drive control pattern is determined depending on the detected vibration level. As a result, it is possible to feed back the vibration level of the developing unit to the drive control of the developing unit, and to prevent deterioration in image formation quality caused by vibrations of the developing unit without halting an image forming operation and using a simple construction.

Preferably, the determining device is operable when the level of vibrations detected by the vibration detecting device is less than a first threshold value, to select a first drive control pattern, and is operable when the level of vibrations detected by the vibration detecting device is not less than the first threshold value, to select a second drive control pattern different from the first drive control pattern.

Preferably, the movement of the developing unit includes a rising operation in which the developing unit is started to move and is moved until a predetermined target speed is reached, and a falling operation in which the developing unit is decelerated and stopped, and the second drive control pattern is set such that a time period required for at least one of the rising operation and the falling operation is longer than a time period required for the at least one of the rising operation and the falling operation according to the first drive control pattern.

More preferably, the movement of the developing unit includes a constant-speed rotation carried out between the rising operation and the falling operation, and the determining device is operable when the level of vibrations during the at least one of the rising operation and the falling operation is not less than the first threshold value and the level of vibrations during the constant-speed rotation is less than a second threshold value, to select a third drive control pattern in which the time period required for the at least one of the rising operation and the falling operation is longer than the time period required for the at least one of the rising operation and the falling operation according to the first drive control pattern, and a speed during the constant-speed rotation is higher than a speed during the constant-speed rotation according to the first drive control pattern.

Also preferably, the movement of the developing unit includes a constant-speed rotation carried out between the rising operation and the falling operation, and the determining device is operable when the level of vibrations during the at least one of the rising operation and the falling operation is not less than the first threshold value and the level of vibrations during the constant-speed rotation is not less than a second threshold value, to select a fourth drive control pattern in which the time period required for the at least one of the rising operation and the falling operation is longer than the time period required for the at least one of the rising operation and the falling operation according to the first drive control pattern, and a speed during the constant-speed rotation is equal to a speed during the constant-speed rotation according to the first drive control pattern.

Preferably, the determining device determines the drive control pattern with respect to each of the image formation colors corresponding to the respective developing devices incorporated in the developing unit.

To attain the above object, in a second aspect of the present invention, there is provided a method of controlling a color image forming apparatus including a developing unit that incorporates developing devices corresponding to respective ones of a plurality of image formation colors, for carrying out a developing process by moving the developing unit to a location for development of an image of each of the plurality of image formation colors when forming an image, comprising a vibration detecting step of detecting a level of vibrations applied to the developing unit, and a determining step of determining a drive control pattern for controlling movement of the developing unit depending on the level of vibrations detected in the vibration detecting step.

To attain the above object, in a third aspect of the present invention, there is provided a control program executed by a color image forming apparatus including a developing unit that incorporates developing devices corresponding to respective ones of a plurality of image formation colors, for carrying out a developing process by moving the developing unit to a location for development of an image of each of the plurality of image formation colors when forming an image, comprising a vibration detecting module for detecting a level of vibrations applied to the developing unit, an a determining module for determining a drive control pattern for controlling movement of the developing unit depending on the level of vibrations detected by the vibration detecting module.

The above and other objects, features, and advantages of the invention will become apparent from the following detailed description taken in conjunction with the accompanying drawings

BRIEF DESCRIPTION OF THE DRAWINGS

FIGS. 4A and 4B are diagrams showing the relationship between the drive control of a rotary motor and the output level of a vibration sensor, in which FIG. 4A shows how the drive control of the rotary motor is carried out and FIG. 4B shows the output level of the vibration sensor;

FIG. 7 is a diagram showing how a drive control pattern for the developing rotary unit is switched;

DETAILED DESCRIPTION OF THE PREFERRED EMBODIMENTS

Figure 1:
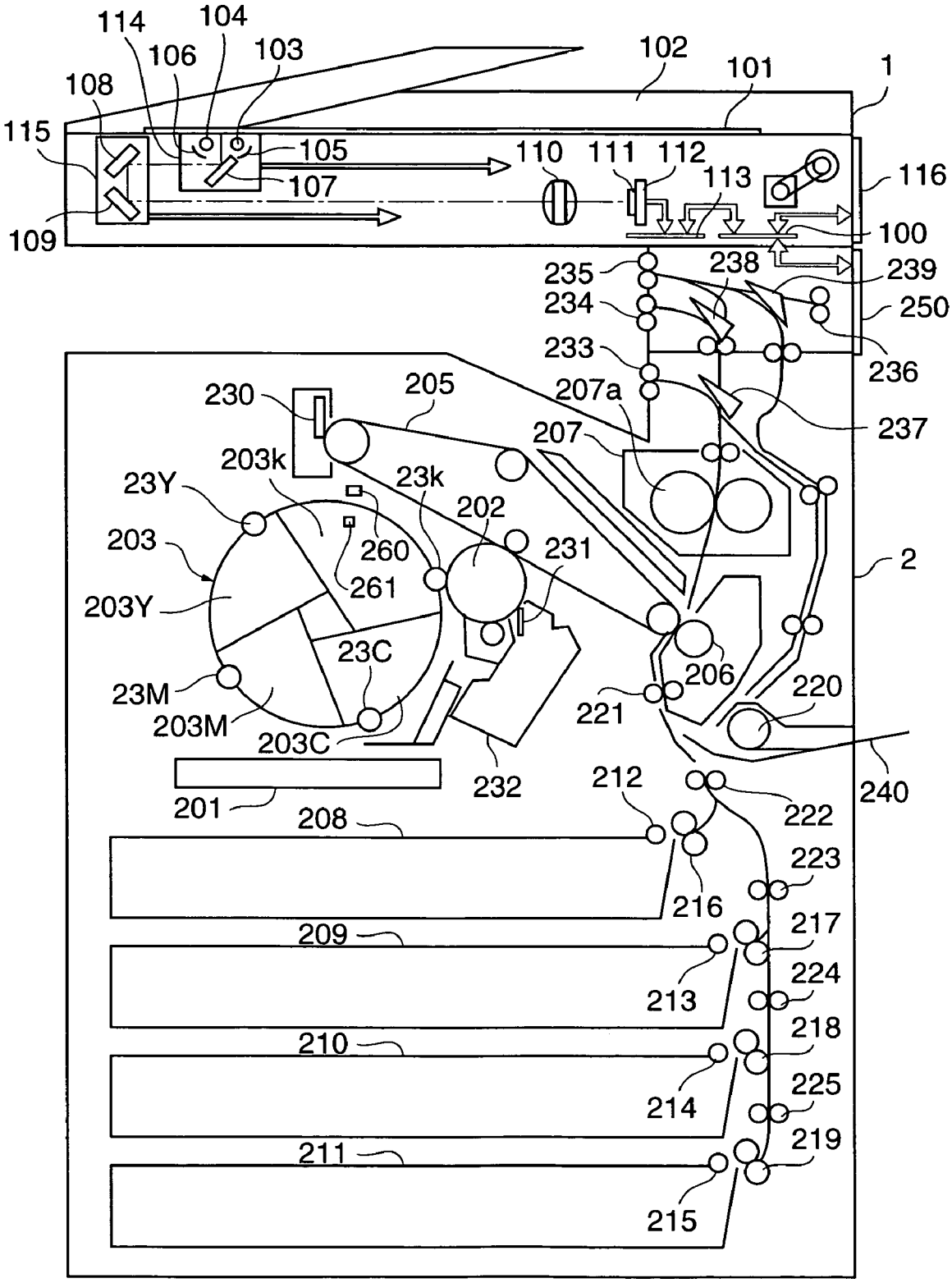
FIG. 1 is a diagram showing the basic construction of a color-image forming apparatus according to an embodiment of the present invention.

The present invention will now be described in detail with reference to the drawings showing a preferred embodiment thereof. In the drawings, elements and parts which are identical throughout the views are designated by identical reference numeral, and duplicate description thereof is omitted.

FIG. 1 is a diagram showing the basic construction of a color image forming apparatus according to an embodiment of the present invention.

First, a description will be given of the construction of a color reader section 1.

The color reader section 1 is installed on top of a main body of the color image forming apparatus. An original tray glass (platen) 101 is mounted on an upper surface of the color reader section 1. An ADF (auto document feeder) 102 that automatically conveys an original to an original reading position is mounted on top of the original tray glass 101. It should be noted that in place of the ADF 102, a mirror platen or a white platen may be mounted on the top of the original tray glass 101.

Carriages (optical reading units) 114 and 115 which are moveable in a sub-scanning direction are housed in the color reader section 1. Light sources 103 and 104, reflectors 105 and 106, and a mirror 107 are housed in the carriage 114. Mirrors 108 and 109 are housed in the carriage 115. The light sources 103 and 104, which illuminate an original, are each implemented by, for example, a halogen lamp, a fluorescent lamp, or a xenon tube lamp. The reflectors 105 and 106 converge light from the light sources 103 and 104 onto an original.

Further, a lens 110 that converges reflected or projected light from the original onto a CCD (charge-coupled device) image sensor (hereinafter simply referred to as "the CCD") 111, the CCD 111 mounted on a substrate 112, a controller 100 that controls the entire image forming apparatus, and a digital image processor 113 are housed in the color reader section 1. An external interface (I/F) 116 that is electrically connected to the controller 100 provides interface for connection to another device.

In reading an original placed on the original tray glass 101, the carriage 114 and the carriages 115 move at a speed V and a speed V/2, respectively, in the sub-scanning direction Y (the directions indicated by the arrows in FIG. 1) perpendicular to the electrically scanning direction of the CCD 111 (main scanning direction X) to thereby scan the entire surface of the original. In reading an original while conveying it using the ADF 102, the carriages 114 and 115 are stopped at original reading positions to read the original being conveyed.

Next, a description will be given of the construction of a color printer section 2.

The color printer section 2 is comprised of a laser scanner 201, a photosensitive drum 202, and a developing rotary unit (hereinafter referred to as "the developing rotary") 203. The developing rotary 203 incorporates developing devices 203Y, 203M, 203C, and 203K containing yellow, magenta, cyan, and black toners, respectively. Sleeves 23Y, 23M, 23C, and 23K with developing biases applied thereto are disposed in the respective developing devices 203Y, 203M, 203C, and 203K.

The laser scanner 201 scans a laser beam corresponding to an image data signal with a polygon mirror, not shown, in the main scanning direction and irradiates the scanned beam onto the photosensitive drum 202. With clockwise rotation of the photosensitive drum 202, an electrostatic latent image formed on the photosensitive drum 202 reaches the position of a predetermined one of the sleeves corresponding to the respective colors in the developing rotary 203. Specifically, a sleeve of a predetermined color is positioned at a predetermined location that is to face the electrostatic latent image on the photosensitive drum 202 in advance by rotating the developing rotary 203, and then the photosensitive drum 202 is rotated clockwise to position the electrostatic latent image in opposed relation to the sleeve.

As a result, a toner in an amount corresponding to the amount of potential formed between the surface of the photosensitive drum 202 with the electrostatic latent image formed thereon and the surface of the sleeve to which a developing bias is applied is jetted from the developing device corresponding to the predetermined color onto the surface of the photosensitive drum 202, and therefore the electrostatic latent image on the surface of the photosensitive drum 202 is developed in the predetermined color. With clockwise rotation of the photosensitive drum 202, the toner image formed on the photosensitive drum 202 is transferred onto an intermediate transfer member 205 rotating counterclockwise.

In the case where the image read by the color reader section 1 is a full-color image, the sleeves are sequentially positioned on a color-by-color basis by rotating the developing rotary 203, and electrostatic latent images corresponding to the respective colors on the photosensitive drum 202 are developed. When toner images in four colors have been primarily transferred (i.e. when the intermediate transfer member 205 has been turned four turns), the primary transfer of the full-color image is completed. In the case where the image read by the color reader section 1 is a black image in monochrome, the sleeve corresponding to the black color is positioned by rotating the developing rotary 203, and a black toner image is formed on the intermediate transfer member 205, thus completing the primary transfer.

On the other hand, for example, four sheet cassettes that contain recording sheets (a first cassette 208, a second cassette 209, a third cassette 210, and a fourth cassette 211) are disposed in the color printer section 2. Recording sheets in the cassettes 208 to 211 are picked up by their respective pickup rollers 212, 213, 214, and 215 and conveyed up to registration rollers 221 via sheet-feeding rollers 216, 217, 218 and 219 and longitudinal path conveying rollers 222, 223, 224, and 225. In manual sheet feeding, recording sheets stacked on a manual feed tray 240 are conveyed up to the registration rollers 221 by a manual sheet-feeding roller 220.

Then, in timing in which the transfer of the electrostatic latent images to the intermediate transfer member 205 is completed, the recording sheet is conveyed to a nip between the intermediate transfer member 205 and a secondary transfer roller 206. Then, the recording sheet is conveyed to a fixing device 207 while being caught between the secondary transfer roller 206 and the intermediate transfer member 205 and attached under pressure to the intermediate transfer member 205. As a result, the toner images on the intermediate transfer member 205 are secondarily transferred onto the recording sheet.

The toner images transferred onto the recording sheet are fixed onto the recording sheet by heating and pressurizing by fixing rollers and pressurizing rollers 207*a*. It should be noted that residual toners remaining on the intermediate transfer member 205 without being transferred onto the recording sheet is cleaned off by after-treatment control in the latter part of the image formation sequence. In this cleaning, a cleaning blade 230 disposed for abutment with and separation from the intermediate transfer member 205 is rubbed against the surface of the intermediate transfer member 205 to scrape the residual toners off the surface of the intermediate transfer member 205.

Also, residual toners are scraped off the surface of the photosensitive drum 202 by a blade 231 and conveyed to a waste toner box 232 integrated with the photosensitive drum 202. Further, positive and negative residual toners that might have been absorbed onto the surface of the secondary transfer roller 206 due to unforeseen causes are cleaned off by alternately applying a secondary transfer positive bias and a secondary transfer negative bias to the positive and negative residual toners to absorb them onto the intermediate transfer member 205 and then scraping off the residual toners with the cleaning blade 230. In this way, the residual toners are completely cleaned off to complete the post-processing control.

In a first sheet discharge mode, a first sheet discharge flapper 237 is switched to a direction toward first sheet discharge rollers 233, and the recording sheet with the image fixed thereon is discharged toward the first discharge rollers 233. In a second sheet discharge mode, the first sheet discharge flapper 237 and a second sheet discharge flapper 238 are switched to a direction toward second sheet discharge rollers 234, and the recording sheet with the image fixed thereon is discharged toward the second discharge rollers 234. In a third sheet discharge mode, the first sheet discharge flapper 237 and the second sheet discharge flapper 238 are switched to a direction toward inversion rollers 236 so that the recording sheet with the image fixed thereon is inverted once by the inversion rollers 236. After the inversion by the inversion rollers 236, a third sheet discharge flapper 239 is switched to a direction toward third sheet discharge rollers 235, and the recording sheet is discharged toward the third sheet discharge rollers 235.

Figure 2:
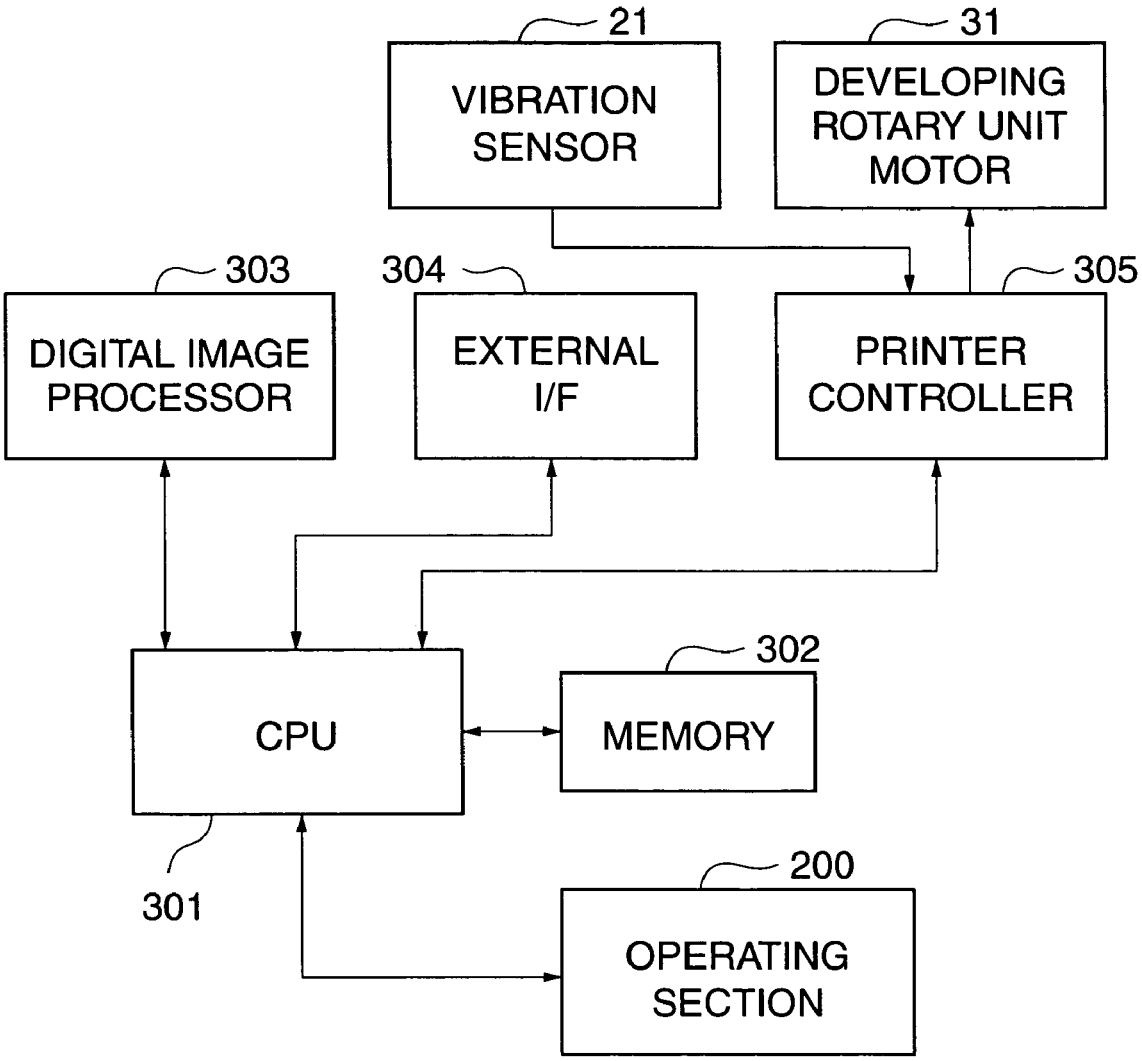
FIG. 2 is a block diagram showing the construction of a controller appearing in FIG. 1.

FIG. 2 is a block diagram showing the construction of the controller 100 appearing in FIG. 1.

The controller 100 is comprised of a CPU 301, a memory 302, a digital image processor 303, an external I/F 304, and a printer controller 305. The CPU 301 executes programs stored in the memory 302 to control an operating section 200, the digital image processor 303, the external I/F 304, and the printer controller 305.

The printer controller 305 receives control signals transmitted from the CPU 301. The controller 100 causes the color reader section 1 to carry out the above described image reading control n to temporarily store read image data in the memory 302 and then transmits the image data in the memory 302 as an image data signal to the printer controller 305 in synchronization with a video clock.

The operating section 200 is installed outside the controller 100 and connected to the CPU 301, and is comprised mainly of an input section comprised of keys for inputting the contents of processing to be executed by an operator, and a liquid crystal display with a touch panel for notifying the operator of information, warnings, and so forth.

The printer controller 305 controls the overall operation of the color printer section 2 appearing in FIG. 1. The color printer section 2 performs printing in accordance with control signals from the printer controller 305. In performing printing, the printer controller 305 inputs a detection signal from a vibration sensor 21 to the color printer section 2, and a developing rotary unit motor (hereinafter referred to as "the rotary motor") 31 for rotating the developing rotary 203 is drivingly controlled in accordance with the detection signal.

Figure 3B:
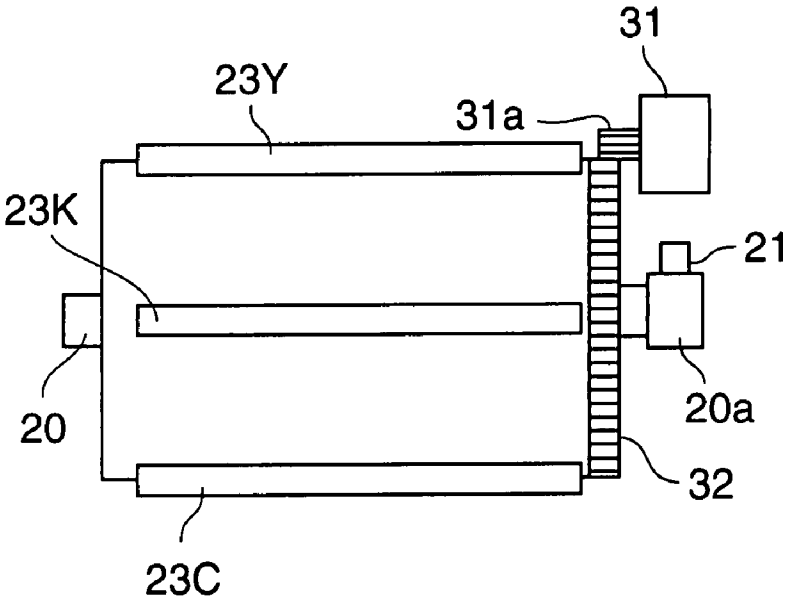
FIG. 3B is a side view showing the developing rotary unit.
Figure 3A:
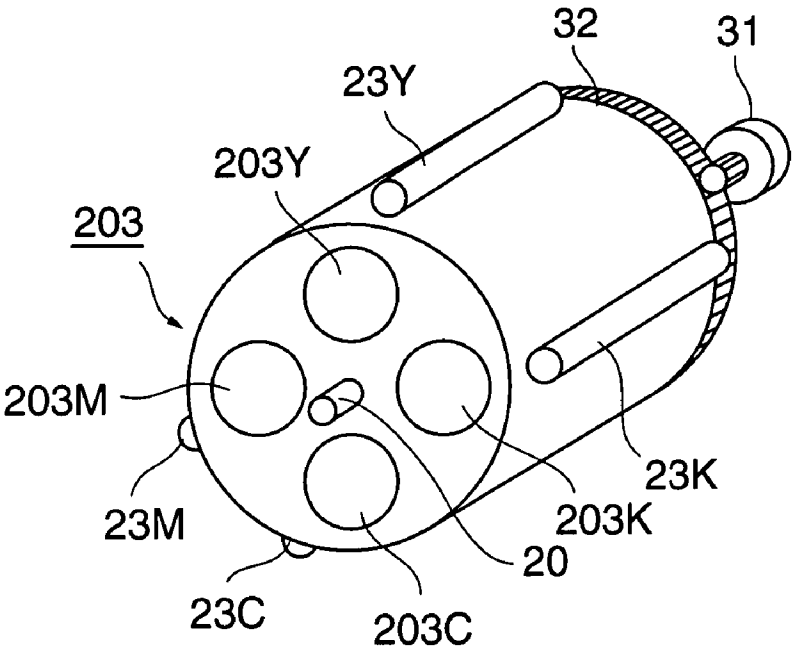
FIG. 3A is a perspective view showing in detail the construction of a developing rotary unit.

FIGS. 3A and 3B are views showing in detail the construction of the developing rotary 203, in which FIG. 3A is a perspective view of the developing rotary 203, and FIG. 3B is a side view of the developing rotary 203.

The developing rotary 203, which is cylindrical-shaped, incorporates the developing devices 203Y, 203M, 203C, and 203K that contain yellow, magenta, cyan, and black toners, respectively. Further, gears 32 are formed on a peripheral edge of an end of the developing rotary 203. The gears 32 and gears 31*a* of the rotary motor 31 are engaged with each other so that rotative driving of the rotary motor 31 causes the entire developing rotary 203 to rotate about a rotary shaft 20 thereof.

The rotation of the developing rotary 203 changes the positions of the sleeves 23Y, 23M, 23C, and 23K corresponding to the yellow, magenta, cyan, and black colors, respectively, to develop images in desired colors on the photosensitive drum 202. The positioning of the sleeves 23Y, 23M, 23C, and 23K (sleeve positioning) is carried out as follows.

That is, a reference position setting sensor 260 (FIG. 1) for setting a reference position of the developing rotary 203 is installed in the vicinity of the developing rotary 203. The position where a home position flag 261 (FIG. 1) attached to the developing rotary 203 passes by the sensor 260 is set as the reference position. Each of the sleeves of the respective four colors is positioned by rotating the rotary motor 31 through a predetermined angle from the reference position. The predetermined angle corresponds to a predetermined number of pulses for driving the rotary motor 31.

On the other hand, the vibration sensor 21 that detects the level of vibrations created during rotation of the developing rotary 203 is fixed on top of a rotary bearing 20*a* of the developing rotary 203. It should be noted that the rotary bearing 20*a* is the most suitable location for installation of the vibration sensor 21 because only vibrations of the developing rotary 203 can be detected with high accuracy. Alternatively, the vibration sensor 21 may be installed on top of the rotary motor 31 or inside the developing rotary 203.

Figure 4A:
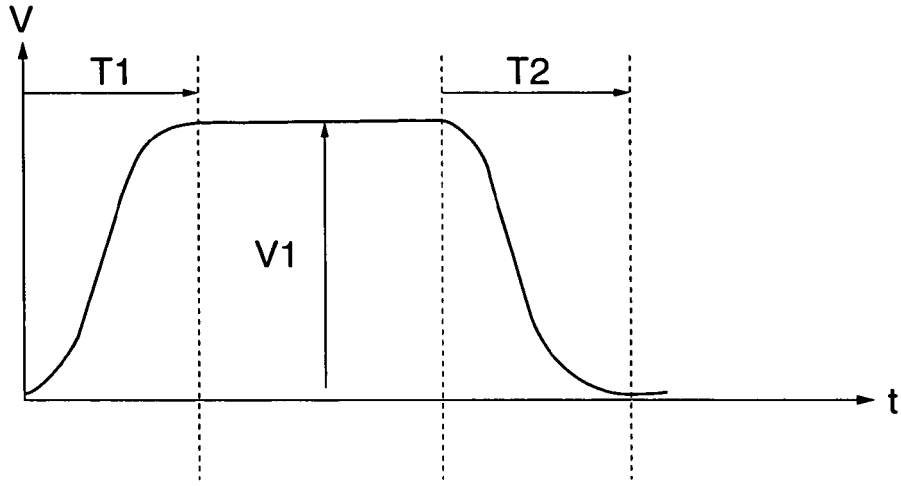
Figure 4B:
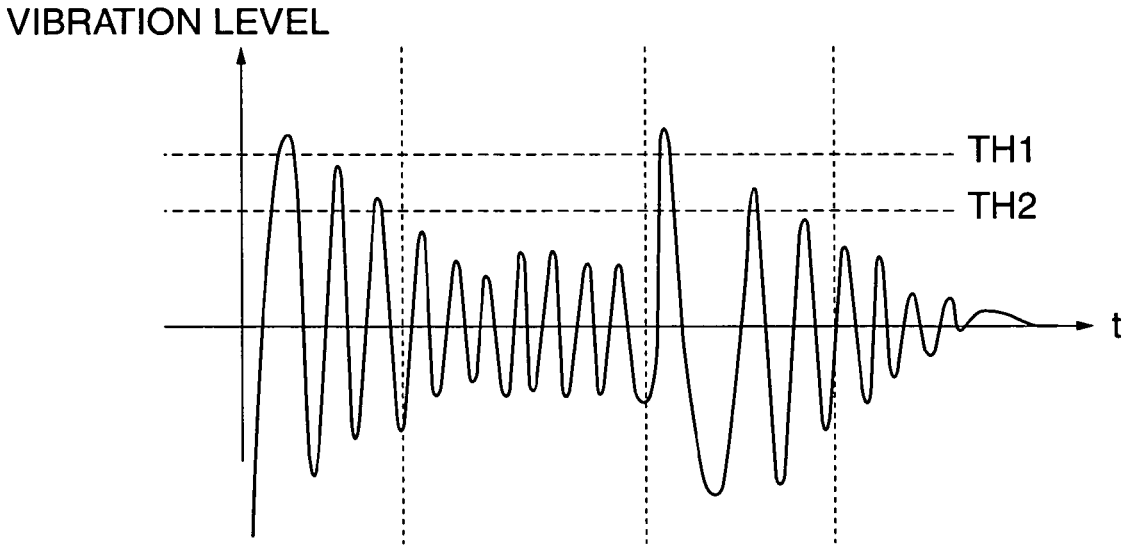

FIGS. 4A and 4B are diagrams showing the relationship between the drive control of the rotary motor 31 and the output level of the vibration sensor 21. FIG. 4A shows how the drive control of the rotary motor 31 is carried out, in which the ordinate represents the rotational speed V, and the abscissa represents elapsed time t. FIG. 4B shows the output level of the vibration sensor 21, in which the ordinate represents the vibration level and the abscissa represents elapsed time t.

As shown in FIG. 4A, after starting rotative driving of the rotary motor 31, the printer controller 305 accelerates the rotation of the rotary motor 31 up to a target speed V1 in a rise time period T1. When the rotational speed of the rotary motor 31 reaches the target speed V1, the printer controller 305 drives the rotary motor 31 to rotate at the constant speed V1.

Then, the printer controller 305 calculates a falling start time so that the developing rotary 203 rotates to a predetermined angle until the rotary motor 31 stops rotating after it starts rotating. At the falling start time, the printer controller 305 decelerates the rotation of the rotary motor 31 and stops it in a fall time period T2. It should be noted that the above-mentioned predetermined angle corresponds to the area inside the graph of FIG. 4A.

On the other hand, as shown in FIG. 4B, a threshold value TH1 and a threshold value TH2 smaller than the threshold value TH1 are set for the vibration level. The threshold value TH1 is for changing the rise time period T1 and the fall time period T2, and the threshold value TH2 is for changing the target speed V1.

Specifically, the optimum values of the threshold values TH1 and TH2 vary from one image forming apparatus to another depending on the dimensions of parts, installation errors, and so forth, and hence the peak value of vibration level during acceleration and the peak value of vibration during constant-speed rotation are measured and stored in advance in the memory 302 at the time of delivery, and the threshold values TH1 and TH2 are set according to the following equations:

$$TH1 = \text{vibration level peak during acceleration} \times 1.5$$

$$TH2 = \text{vibration level peak during constant-speed rotation} \times 1.5$$

It should be noted that the values of the threshold values TH1 and TH2 are not limited to those obtained by multiplying the peak values by 1.5, but may vary depending on the construction of the image forming apparatus.

In the following description, a pattern in which the rise time period T1, the fall time period T2, and the target speed V1 are all constant values in the drive control of the rotary motor 31 will hereafter be referred to as the "standard drive pattern", although drive control patterns for the rotary motor 31 depending on the threshold values TH1 and TH2 will be described later in further detail with reference to FIG. 7.

For example, constant values of the rise time period T1, the fall time period T2, and the target speed V1 are as follows: T1=200 ms, T2=100 ms, and V1=1000 pps (pulse per second). The constant values depend on the characteristics of the rotary motor 31 and the gear ratio of the rotary motor 31 to the developing rotary 203. The constant values are stored in the memory 302, and they are read out from the memory 302 and used when the drive control of the rotary motor 31 is carried out using the standard drive pattern.

Then, the rise time period T1, the fall time period T2, or the target speed V1 is changed from the constant value to another in accordance with the vibration level detected by the vibration sensor 21, and control for changing the drive control pattern from the standard drive pattern to the optimum drive pattern is carried out.

Figure 5:
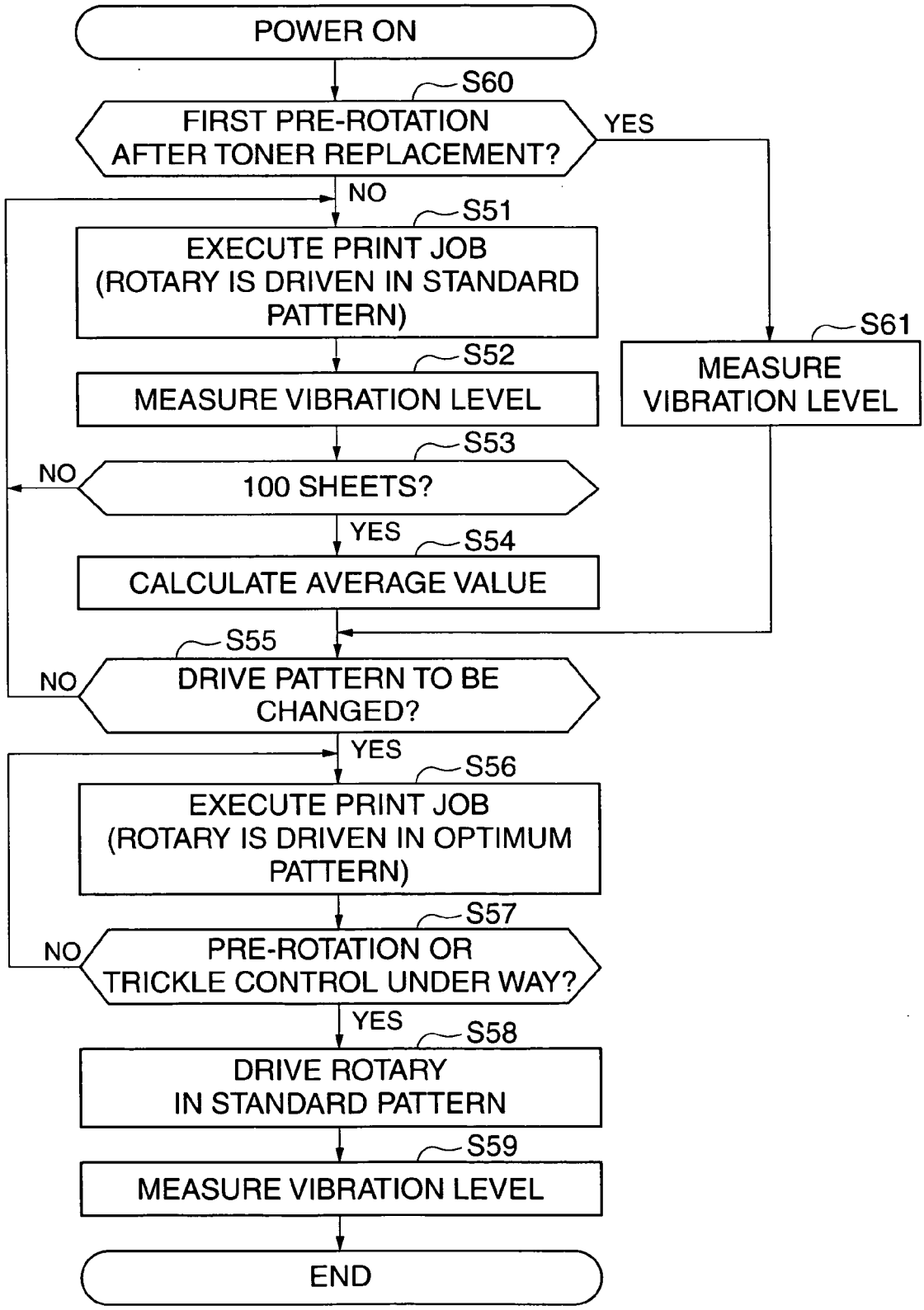
FIG. 5 is a flow chart showing timing of measurement of the vibration level.

Referring next to FIG. 5, a description will be given of the timing for measuring the vibration level by the vibration sensor 21.

FIG. 5 is a flow chart showing timing of measurement of the vibration level. In this flow chart, the measurement of the vibration level is carried out using the vibration sensor 21, but other processes are carried out by the printer controller 305. It should be noted that a print job is input to the controller 100.

First, it is determined whether or not it is the timing for the image forming apparatus to execute first pre-rotation including rotation of the developing rotary 203 after toner replacement (step S60). The pre-rotation is carried out to make preparations for forming an electrostatic latent image on the photosensitive drum 202, such as adjusting the characteristics of the photosensitive drum 202 uniformly over the circumference thereof before an electrostatic latent image is formed on the photosensitive drum 202, or adjusting the characteristics of the photosensitive drum 202 so that its surface potential becomes equal to a predetermined value. Also, the pre-rotation includes determination of conditions for producing a test pattern on the photosensitive drum 202 and measuring the density of the produced test pattern to correct gradation characteristics.

If it is determined in the step S60 that it is the time to carry out the first pre-rotation after toner replacement, a variation in the vibration level is expected to be great, and hence measurement of the vibration level is forced to be started and the measurement result is reflected in the print job (step S61). On the other hand, if it is determined in the step S60 that it is not the time to carry out the first pre-rotation after toner replacement, the drive control of the rotary motor 31 is carried out using the standard drive pattern so that the print job is executed, and the vibration level is measured during the execution of the print job (steps S51 and S52). In this way, the vibration level is measured basically during the execution of a job, but during the execution of the job, the drive control pattern for the rotary motor 31 is kept unchanged so as to prevent the quality of an image of one page from partially changing.

Then, to suppress measurement errors, measured values of the vibration level are averaged once every predetermined number of sheets (in the present embodiment, 100 sheets) (steps S53 and S54). Based upon the averaging result, it is determined whether to change the drive control pattern from the standard drive pattern to the optimum drive pattern in the next job (step S55). If it is determined that the drive control pattern is not to be changed from the standard drive pattern to the optimum drive pattern, the process returns to the step S51.

If it is determined in the step S55 that the drive control pattern is to be changed from the standard drive pattern to the optimum drive pattern, the drive control pattern is changed to the optimum drive pattern and then the next print job is executed (step S56). The vibration level is not measured during the execution of the print job. It is then determined whether or not the image forming apparatus is carrying out pre-rotation and trickle control (waste toners are collected by rotating the developing rotary 203) in an automatic adjustment mode (step S57). If it is determined that the image forming apparatus is not carrying out pre-rotation and trickle control in the automatic adjustment mode, the process returns to the step S56. On the other hand, if it is determined that the image forming apparatus is carrying out pre-rotation and trickle control in the automatic adjustment mode, the vibration level during operation using the standard drive pattern is measured (steps S58 and S59), and the process returns to the step S56.

Figure 6A:
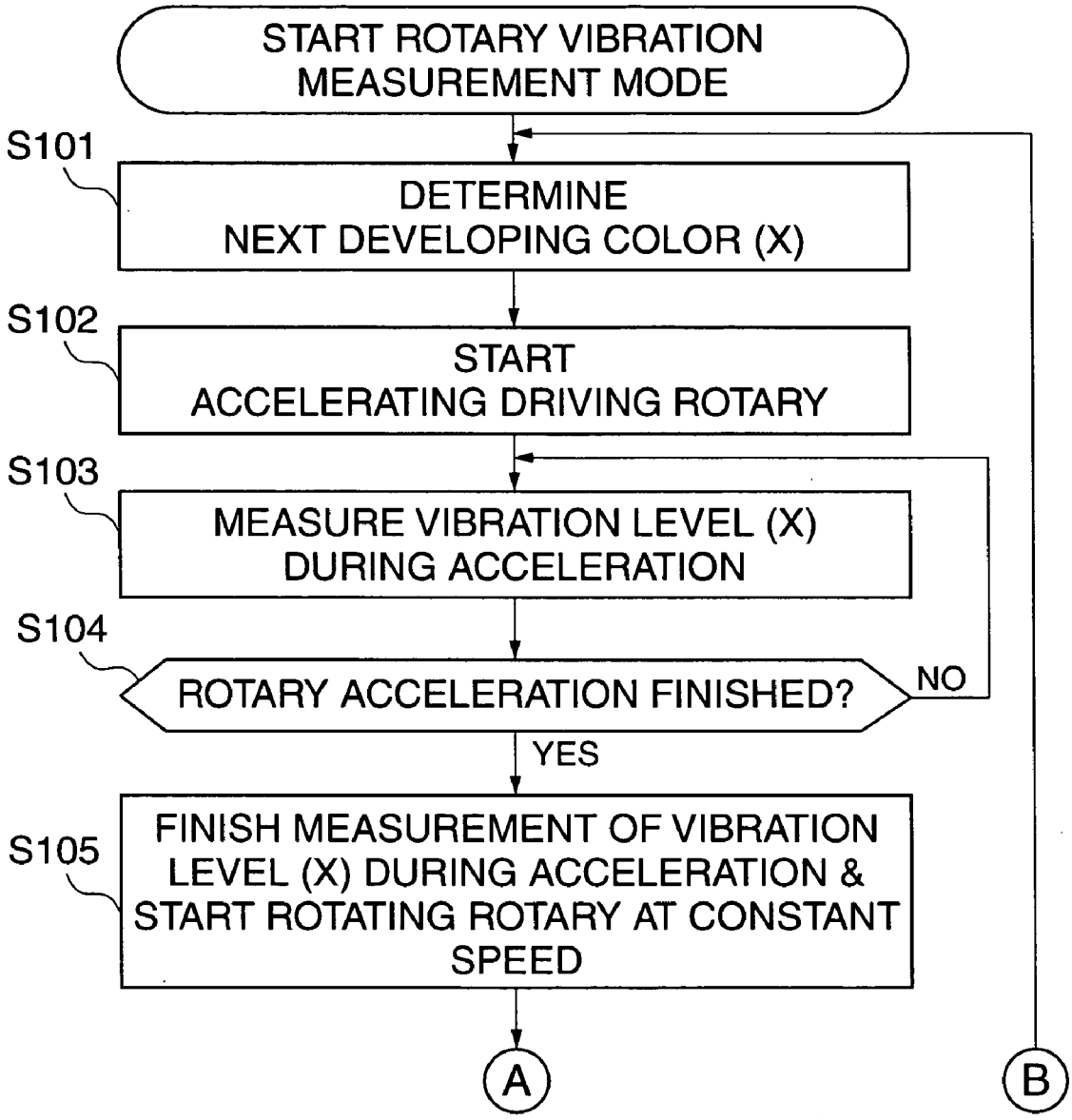
FIGS. 6A and 6B are flow charts showing a process for measuring the vibration level.
Figure 6B:
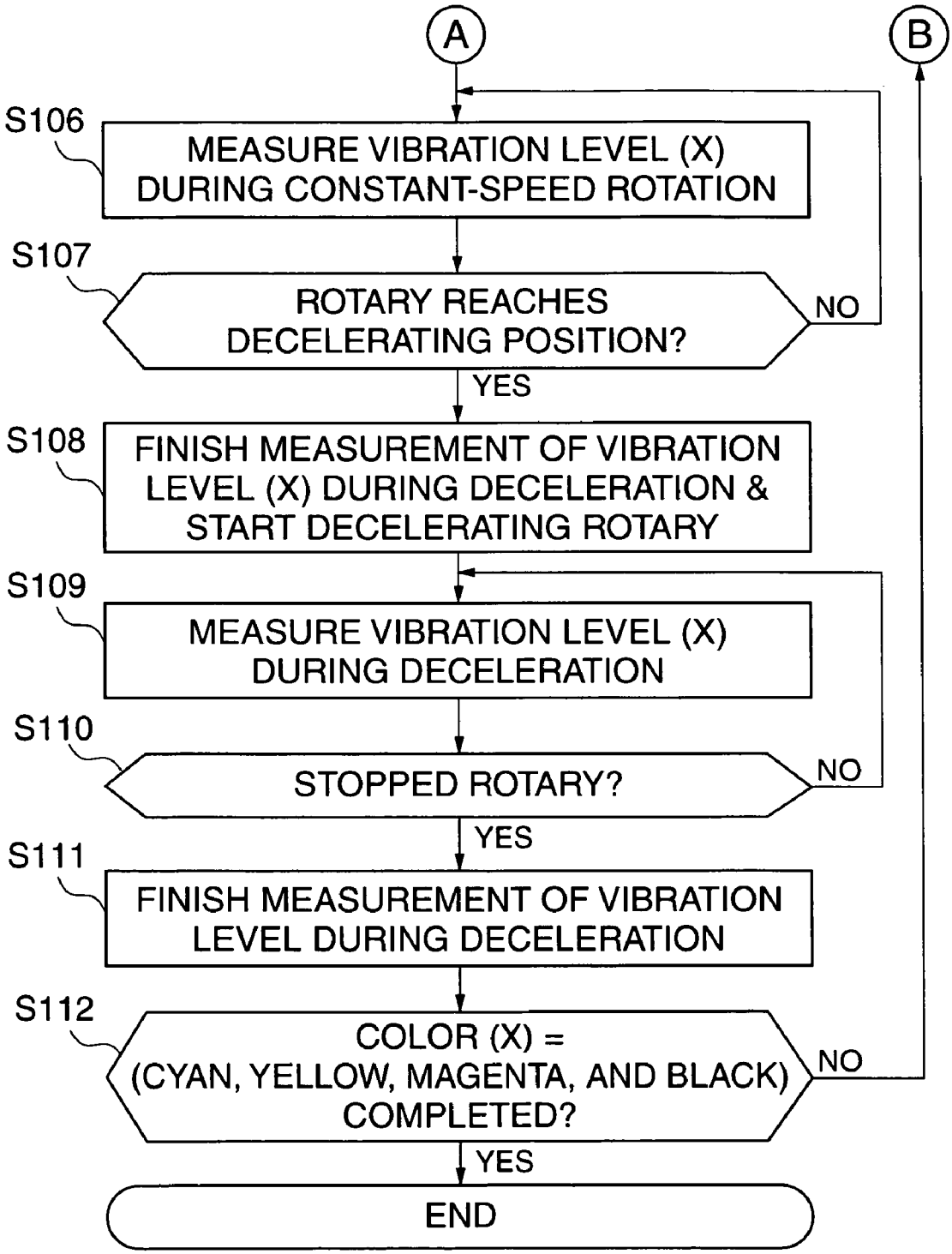

Referring next to FIGS. 6A and 6B, a description will be given of the flow of vibration level measurement control carried out in the measurement timing described above.

FIGS. 6A and 6B are flow charts showing the flow of vibration level measurement control. In this flow chart, the measurement of the vibration level is carried out using the vibration sensor 21, but other processes are carried out by the printer controller 305.

When a mode of measuring the vibrations of the developing rotary 203 is started, one developing color (X) is determined first (step S101), and the rotational speed of the developing rotary 203 is increased according to the standard drive pattern so as to perform sleeve positioning suitable for the developing color (X) (step S102). On this occasion, the vibration level during acceleration as the output level of the vibration sensor 21 is measured by sampling values of the vibration level at predetermined time intervals (in the present embodiment, every 50 ms, for example) (step S103). This measurement is continuously carried out until the acceleration is finished (steps S104 and S105), and an average value of the vibration level values during acceleration sampled during the acceleration is calculated and stored in the memory 302.

When the acceleration of the developing rotary 203 is finished, the mode of driving the developing rotary 203 is shifted to constant-speed drive (step S105), and the measurement of the vibration level during constant-speed rotation is started (step S106). This measurement is continuously carried out until the developing rotary 203 reaches a decelerating position (steps S107 and S108). In the measurement, values of the vibration level during constant-speed rotation, which are transmitted from the vibration sensor 21, are sampled at predetermined time intervals (for example, every 50 ms), and an average value of the vibration level values is calculated and stored in the memory 302.

Then, when the constant-speed driving of the developing rotary 203 is finished, the mode of driving the developing rotary 203 is shifted to decelerating drive (step S108), and the measurement of the vibration level during deceleration is started (step S109). This measurement is continuously carried out until the developing rotary 203 stops rotating (steps S110 and S111). In the measurement, values of the vibration level during deceleration, which are transmitted from the vibration sensor 21, are sampled at predetermined time intervals (for example, every 50 ms), and an average value of the vibration level values is calculated and stored in the memory 302.

The measurements described above are carried out with respect to all the developing colors (cyan, yellow, magenta, and black) (step S112), and the present measurement mode is completed.

FIG. 7 is a diagram showing how the drive control pattern for the developing rotary 203 (rotary motor 31) is switched. In FIG. 7, constant values of the rise time period T1, the fall time period T2, and the target speed V1 are designated by T1*r*, T2*r*, and V1*r*, respectively.

As shown in FIG. 7, when the vibration level during -acceleration and the vibration level during deceleration are less than the threshold value TH1, the printer controller 305 selects the standard drive pattern in which the rise time period T1 is set to the constant value T1*r* (this setting will be referred to as the "standard rising pattern"), the fall time period T2 is set to the constant value T2*r* (this setting will be referred to as the "standard falling pattern"), and the target speed V1 is set to the constant value V1*r*.

When the vibration level during acceleration and the vibration level during deceleration are not less than the threshold value TH1, the printer controller 305 selects the optimum drive pattern in which the rise time period T1 and the fall time period T2 are longer than the constant values T1*r* and T2*r*, respectively (for example, the rise time period T1 and the fall time period T2 are set to be 5 to 30% longer than the constant values in accordance with the vibration levels, or may be fixed at values that are about 15% longer than the constant values), and the target speed V1 is changed according to the vibration level during constant-speed rotation. In the optimum drive pattern, if the vibration level during constant-speed rotation is less than the threshold value TH2, the target speed V1 is made greater than the constant value V1*r*, and if the vibration level during constant-speed rotation is not less than the threshold value TH2, the target speed V1 is made equal to the constant value V1*r*.

Thus, according to the optimum drive pattern, when the vibration level during acceleration is not less than the threshold value TH1, the rise time period T1 is made longer than the constant value T1*r* so as to suppress vibrations, so that the rotary motor 31 is slowly started up (this setting will be referred to as the "slow rising pattern"). In the slow rising pattern, the startup acceleration is smaller than in the standard rising pattern. When the vibration level during deceleration is not less than the threshold value TH1, the fall time period T2 is made longer than the constant value T2*r* so as to suppress vibrations, so that the rotary motor 31 is slowly stopped (this setting will be referred to as the "slow falling pattern"). In the slow falling pattern, the falling acceleration is smaller than in the standard falling pattern.

With the above setting, however, it takes a long time to rotate the developing rotary 203 through the predetermined angle, and hence, if the occurrence of vibrations is caused by acceleration or deceleration (i.e. the vibration level during constant-speed rotation is less than the threshold value TH2), the rotative driving speed (target speed) V1 in constant-speed rotation is made greater than the constant value V1*r* so that the time period required to rotate the developing rotary 203 through the predetermined angle can be equal to that in the standard drive pattern. That is, when the vibration level during constant-speed rotation is less than the predetermined threshold value TH2, it is determined that making the rotative driving speed V1 during constant-speed rotation greater than the constant value V1*r* would not affect an image. However, when the vibration level during constant-speed rotation is not less than the predetermined threshold value TH2, the rotative driving speed (target speed) V1 during constant-speed rotation is kept unchanged at the constant value V1*r* so as not to affect an image.

Figure 8A:
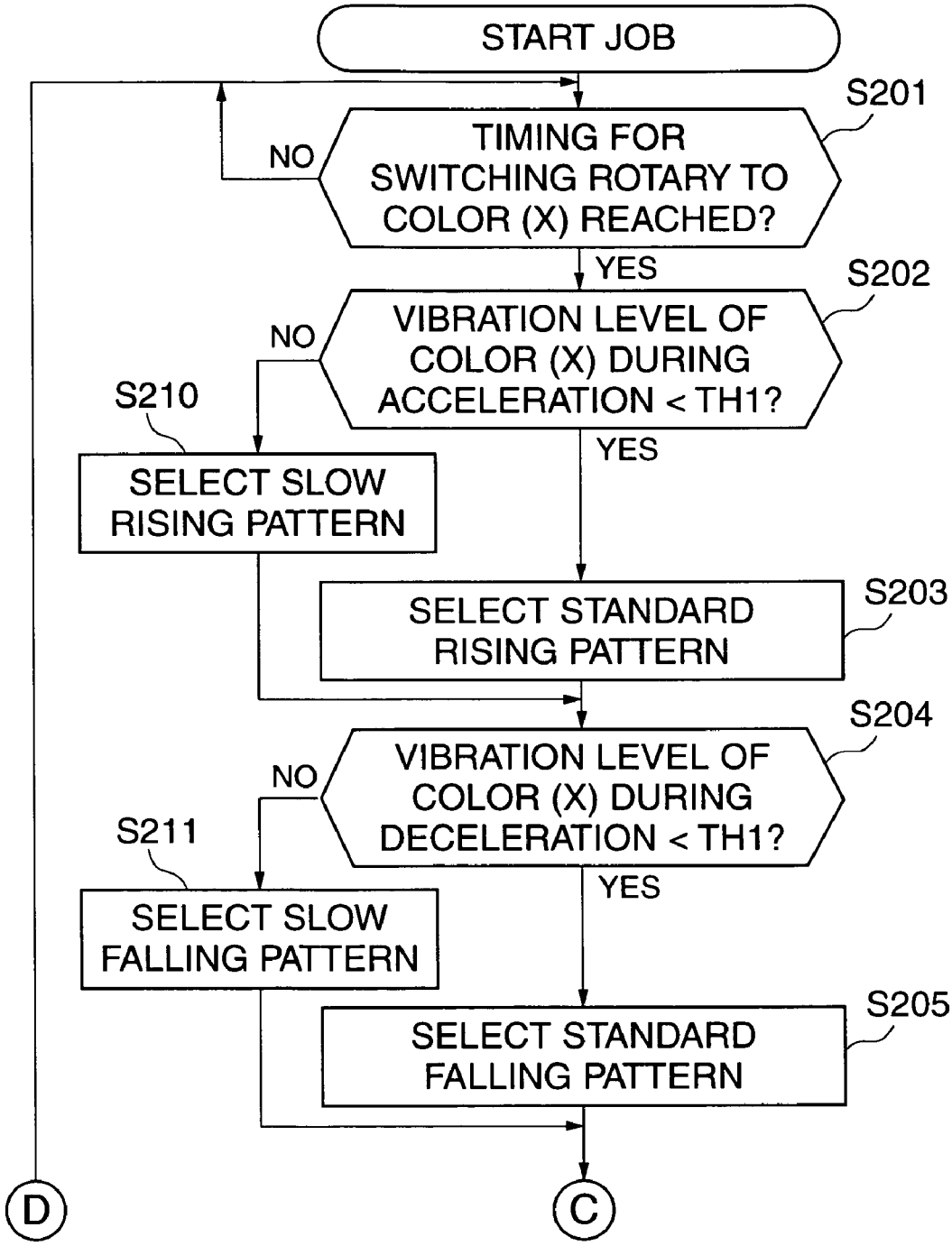
FIGS. 8A and 8B are flow charts showing a process for changing the drive control pattern for the developing rotary unit.
Figure 8B:
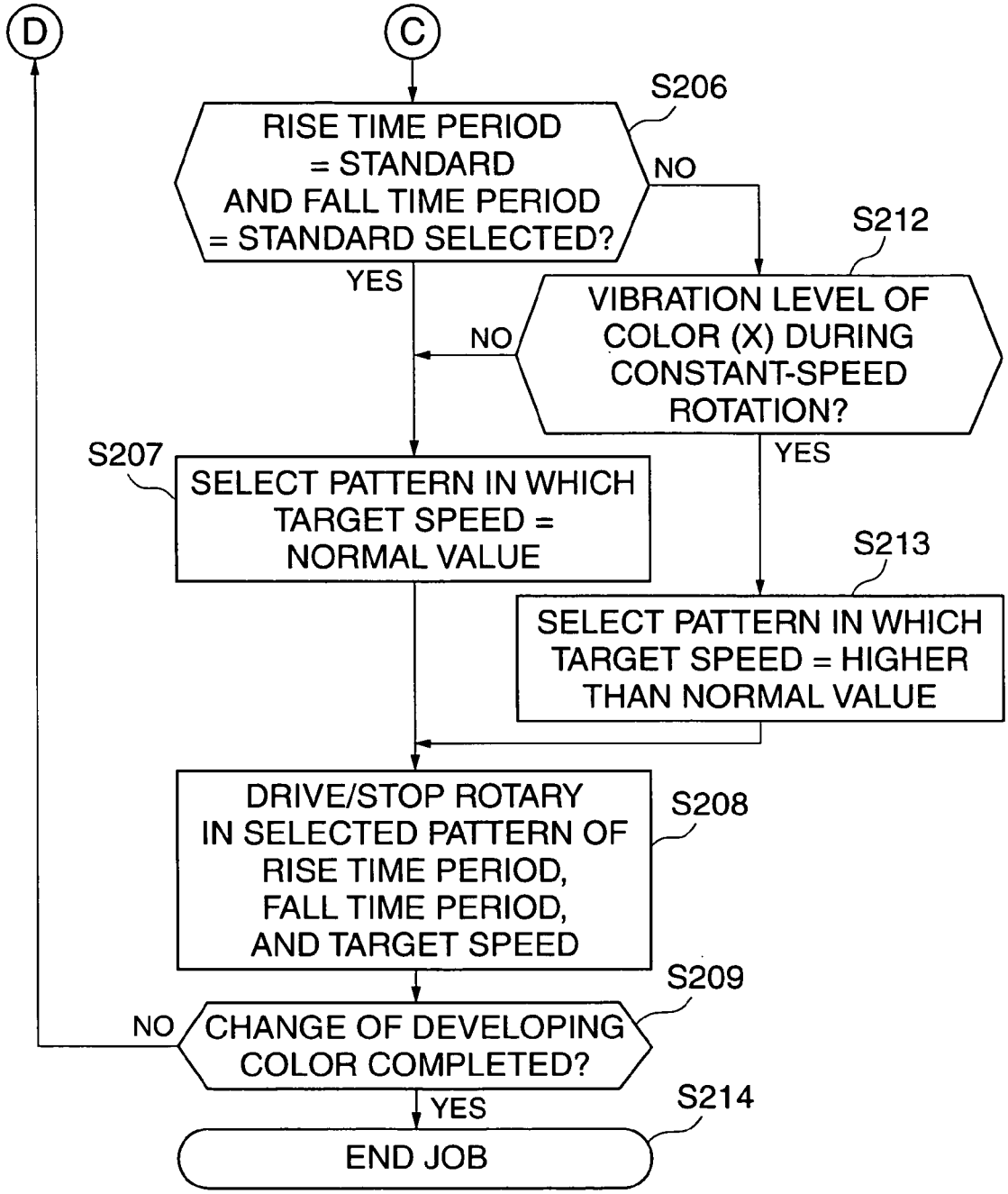
Figure 9:
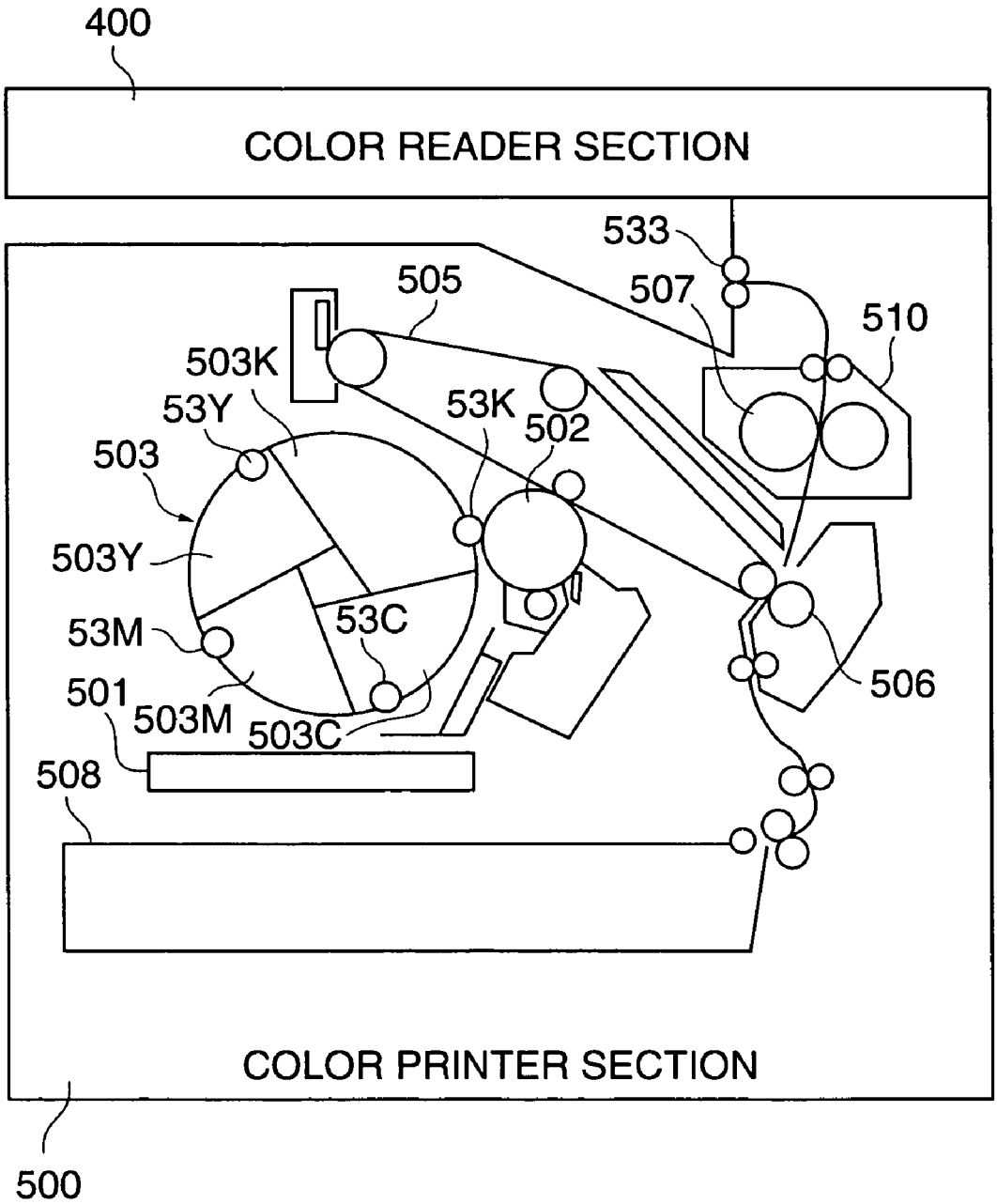
FIG. 9 PRIOR ART
FIG. 9 is a diagram schematically showing a conventional full-color image forming apparatus.

Referring next to FIGS. 8A and 8B, a description will be given of control to change the drive control pattern for the developing rotary 203, which is actually carried out during the execution of a job.

FIGS. 8A and 8B are flow charts showing a process for changing the drive control pattern for the developing rotary 203, which is actually carried out during the execution of a job. It should be noted that the control to change the drive control pattern is carried out by the printer controller 305.

When it is the timing for switching the developing rotary 203 to the predetermined color (X) during the execution of the job (step S201), the vibration level during acceleration with respect to the predetermined color (X) and the threshold value TH1 are compared with each other (step S202). If the vibration level during acceleration is less than the threshold value TH1, it is determined that vibrations during the rise time period are at a low level, and the standard rising pattern is selected (step S203). If the vibration level during acceleration is not less than the threshold value TH1, the slow rising pattern in which the rise time period is longer than in the standard rise time period is selected (step S210).

Similarly, the vibration level during deceleration with respect to the predetermined color (X) and the threshold value TH1 are compared with each other (step S204). If the vibration level during deceleration is less than the threshold value TH1, it is determined that vibrations during the fall time period are at a low level and the standard falling pattern is selected (step S205). If the vibration level during deceleration is not less than the threshold value TH1, the slow falling pattern in which the fall time period is longer than in the standard falling pattern is selected (step S211).

Next, the target speed V1 is determined. If the standard patterns (the standard rising pattern and the standard falling pattern) are selected with respect to both the rise time period and the fall time period (step S206), the pattern in which the target speed V1 is a normal value is selected (step S207), and the developing rotary 203 is controlled to be rotated/stopped (step S208).

On the other hand, if the standard pattern (the standard rising pattern or the standard falling pattern) is not selected with respect to either of the rise time period and the fall time period, the vibration level during constant-speed rotation and the threshold value TH2 are compared with each other (step S212). If the vibration level during constant-speed rotation is less than the threshold value TH2, a pattern in which the target speed V1 is higher than in the standard drive pattern is selected (step S213), and the developing rotary 203 is controlled to be rotated/stopped (step S208).

If the vibration level during constant-speed rotation is not less than the threshold value TH2, the pattern in which the target speed V1 is set to a normal value is selected (step S207), and the developing rotary 203 is controlled to be rotated/stopped (step S208).

The control to change the drive control patterns as described above is carried out independently with respect to each color in timing in which the developing rotary 203 starts rotating during the execution of a job.

As described above, according to the present embodiment, in the rotary developing type color image forming apparatus, when the rotation of the developing rotary 203 is controlled for sleeve positioning, the vibration level of the developing rotary 203 during rotation is detected using the vibration sensor 21, and the drive control pattern is determined depending on the detected vibration level. As a result, the degree of vibration level of the developing rotary 203 can be fed back to the rotative control of the developing rotary 203, and hence adverse effects on image quality caused by vibrations of the developing rotary 203 can be prevented without halting an image forming operation and using a simple construction that does not require a special device for causing vibrations. Also, it is possible to determine the drive control pattern with respect to each color depending on the detected vibration level, and hence adverse effects on image quality caused by vibrations of the developing rotary 203 can be prevented with respect to each color.

Although in the above described embodiment, the rise time period T1, the fall time-period T2, and the target speed V1 (drive control pattern) can be determined depending on detected vibration levels (the vibration level during constant-speed rotation, the vibration level during acceleration, and the vibration level during decelerating), the present invention is not limited to this, but the printer controller 305 may calculate and determine the rise time period T1, the fall time period T2, and the target speed V1 (drive control pattern) one by one based on equations for the rise time period T1, the fall time period T2, and the target speed V1, as well as detected vibration levels.

The present invention can be applied not only to the rotary developing unit, but also to a driving motor that performs development by moving a developing unit, which is comprised of a plurality of developing devices arranged in a line, in the direction in which the developing devices are arranged.

It is to be understood that the object of the present invention may also be accomplished by supplying a system or an apparatus with a storage medium in which a program code of software, which realizes the functions of the above described embodiment is stored, and causing a computer (or CPU or MPU) of the system or apparatus to read out and execute the program code stored in the storage medium.

In this case, the program code itself read from the storage medium realizes the functions of the above described embodiment, and hence the program code and a storage medium on which the program code is stored constitute the present invention.

Examples of the storage medium for supplying the program code include a floppy (registered trademark) disk, a hard disk, a magnetic-optical disk, an optical disk such as a CD-ROM, a CD-R, a CD-RW, a DVD-ROM, a DVD-RAM, a DVD-RW, and a DVD+RW, a magnetic tape, a nonvolatile memory card, and a ROM. Alternatively, the program code may be downloaded via a network.

Further, it is to be understood that the functions of the above described embodiment may be accomplished not only by executing a program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided in an expansion board inserted into a computer or a memory provided in an expansion unit connected to the computer and then causing a CPU or the like provided in the expansion board or the expansion unit to perform a part or all of the actual operations based-on instructions of the program code.

CROSS REFERENCE TO RELATED APPLICATION

This application claims priority from Japanese Patent Application No. 2004-290564 filed Oct. 1, 2004, which is hereby incorporated by reference herein.

What is claimed is:

1. A color image forming apparatus comprising:

a developing unit that incorporates developing devices corresponding to respective ones of a plurality of image formation colors;

a development unit driving device that moves said developing unit to a location for development of an image of each of the plurality of image formation colors when forming an image;

a vibration detecting device that detects a level of vibrations applied to said developing unit; and a determining device that is capable of changing a drive control pattern for control driving of said developing unit driving device, and determines the drive control pattern depending on the level of vibrations detected by said vibration detecting device.

2. A color image forming apparatus according to claim 1, wherein said determining device is operable when the level of vibrations detected by said vibration detecting device is less than a first threshold value, to select a first drive control pattern, and is operable when the level of vibrations detected by said vibration detecting device is not less than the first threshold value, to select a second drive control pattern different from the first drive control pattern.

3. A color image forming apparatus according to claim 1, wherein:

the movement of said developing unit includes a rising operation in which said developing unit is started to move and is moved until a predetermined target speed is reached, and a falling operation in which said developing unit is decelerated and stopped, and the second drive control pattern is set such that a time period required for at least one of the rising operation and the falling operation is longer than a time period required for the at least one of the rising operation and the falling operation according to the first drive control pattern.

4. A color image forming apparatus according to claim 3, wherein:

the movement of said developing unit includes a constant-speed rotation carried out between the rising operation and the falling operation, and said determining device is operable when the level of vibrations during the at least one of the rising operation and the falling operation is not less than the first threshold value and the level of vibrations during the constant-speed rotation is less than a second threshold value, to select a third drive control pattern in which the time period required for the at least one of the rising operation and the falling operation is longer than the time period required for the at least one of the rising operation and the falling operation according to the first drive control pattern, and a speed during the constant-speed rotation is higher than a speed during the constant-speed rotation according to the first drive control pattern.

5. A color image forming apparatus according to claim 3, wherein:

the movement of said developing unit includes a constant-speed rotation carried out between the rising operation and the falling operation, and said determining device is operable when the level of vibrations during the at least one of the rising operation and the falling operation is not less than the first threshold value and the level of vibrations during the constant-speed rotation is not less than a second threshold value, to select a fourth drive control pattern in which the time period required for the at least one of the rising operation and the falling operation is longer than the time period required for the at least one of the rising operation and the falling operation according to the first drive control pattern, and a speed during the constant-speed rotation is equal to a speed during the constant-speed rotation according to the first drive control pattern.

6. A color image forming apparatus according to claim 1, wherein said determining device determines the drive control pattern with respect to each of the image formation colors corresponding to the respective developing devices incorporated in said developing unit.

7. A method of controlling a color image forming apparatus including a developing unit that incorporates developing devices corresponding to respective ones of a plurality of image formation colors, for carrying out a developing process by moving the developing unit to a location for development of an image of each of the plurality of image formation colors when forming an image, comprising:

a vibration detecting step of detecting a level of vibrations applied to the developing unit; and a determining step of determining a drive control pattern for controlling movement of the developing unit depending on the level of vibrations detected in said vibration detecting step.

8. A control program executed by a color image forming apparatus including a developing unit that incorporates developing devices corresponding to respective ones of a plurality of image formation colors, for carrying out a developing process by moving the developing unit to a location for development of an image of each of the plurality of image formation colors when forming an image, comprising:

a vibration detecting module for detecting a level of vibrations applied to the developing unit; and a determining module for determining a drive control pattern for controlling movement of the developing unit depending on the level of vibrations detected by said vibration detecting module.

* * * * *